US006886268B1

(12) United States Patent
Morse

(10) Patent No.: US 6,886,268 B1
(45) Date of Patent: May 3, 2005

(54) SIDING INSTALLATION TOOL AND METHOD OF INSTALLING SIDING

(75) Inventor: Rick James Morse, Grass Lake, MI (US)

(73) Assignee: Certainteed Corporation, Valley Forge, PA (US)

( * ) Notice: Subject to any disclaimer, the term of this patent is extended or adjusted under 35 U.S.C. 154(b) by 0 days.

(21) Appl. No.: 10/745,222

(22) Filed: Dec. 22, 2003

(51) Int. Cl.[7] ..... G01D 21/00

(52) U.S. Cl. ..... 33/647; 33/429; 33/481; 52/749.1; 52/DIG. 1; 81/45

(58) Field of Search ..... 33/647, 646, 648, 33/649, 42, 411, 416, 417, 420, 421, 423, DIG. 16, 429, 481; 52/749.1, 749.11, DIG. 1; 81/45

(56) References Cited

U.S. PATENT DOCUMENTS

| | | | | | |
|---|---|---|---|---|---|
| 421,746 | A | * | 2/1890 | Mooney | 33/411 |
| 454,017 | A | * | 6/1891 | Arnold | 33/411 |
| 888,985 | A | * | 5/1908 | Finn | 33/33 |
| 3,352,016 | A | * | 11/1967 | Jablonsky | 33/423 |
| 4,079,562 | A | | 3/1978 | Englert et al. | |
| 4,089,141 | A | * | 5/1978 | Heroux | 52/105 |
| 4,314,429 | A | * | 2/1982 | Casteel et al. | 52/127.2 |
| 4,854,101 | A | | 8/1989 | Champagne | |
| 4,936,021 | A | * | 6/1990 | Frenette et al. | 33/649 |
| 5,410,852 | A | | 5/1995 | Edgar et al. | |
| 5,522,149 | A | * | 6/1996 | Meyer | 33/646 |
| 5,564,245 | A | * | 10/1996 | Rademacher | 52/520 |
| 5,634,314 | A | | 6/1997 | Champagne | |
| 5,727,325 | A | * | 3/1998 | Mussell | 33/429 |
| 6,367,220 | B1 | | 4/2002 | Krause et al. | |
| 6,622,394 | B2 | | 9/2003 | Werner et al. | |
| 6,688,014 | B1 | * | 2/2004 | Allemand | 33/474 |
| 6,705,021 | B2 | * | 3/2004 | Nadal et al. | 33/647 |
| 2002/0023366 | A1 | * | 2/2002 | Bueno | 33/647 |

FOREIGN PATENT DOCUMENTS

AU 98885 S 12/1997

OTHER PUBLICATIONS

Cedar Valley Handy Panels, Cedar Valley Shingle Systems, 1998, Trade Literature.

(Continued)

*Primary Examiner*—Christopher W. Fulton
*Assistant Examiner*—Amy R. Cohen
(74) *Attorney, Agent, or Firm*—Duane Morris LLP

(57) ABSTRACT

A siding installation tool is provided comprising a main body portion including a spacing flange. The spacing flange includes a hook member disposed to hang the tool from a top edge of a first siding panel and a seat member disposed to receive the bottom edge of a second siding panel, wherein the flange portion is sized to provide a partial overlap of the first siding panel by the second siding panel when the tool is attached to the first siding panel by the hook member and the second siding panel is seated in the seat. The tool also includes measuring means located on the tool.

20 Claims, 4 Drawing Sheets

OTHER PUBLICATIONS

Cemtrim Premium Fiber–Cement Trim, Trade Literature.
Azek Trimboards, Vycom Corp. Trade Literature.
Royal Wood® Precision Composites, Inc. Trade Literature.
HardiTRIM HLD™ Technology Exterior Trim, James Harding Siding Products, 1999, Trade Literature.
American Classics, Maibec, Trade Literature.
TruWood® Manufactured by Collins Products LLC Siding, Trade Literature.
Snapper Siding is Really Great Shakes, Pacific International Siding Co., Trade Literature.
Technical Bulletin 2004, Fancy Cuts Panel, Shakertown 1992, Inc., Trade Literature.
Cement Boards, NERAC, Inc., Jun. 20, 2002.
Owens Corning Exterior System, Sep. 10, 2000, Trade Literature.
Cedar Valley Shingle Siding Panels, Cedar Valley Shingle Systems, 1999, Trade Literature.
Weather Boards, Fibercement Siding, CertainTeed, Nov. 2001, Trade Literature.
"Standard Test Methods of Conducting Strength Tests of Panels for Building Construction," ASTM, Designation: E72–98, ASTM, Jun. 1998, pp. 539–549.
Lstiburek, Joseph, "Water–Managed Wall Systems," Journal of Light Construction, Mar. 2003.

* cited by examiner

SIDING INSTALLATION TOOL AND METHOD OF INSTALLING SIDING

FIELD OF THE INVENTION

The present invention relates to construction, and, more particularly, to a tool to facilitate installation of siding products.

BACKGROUND OF THE INVENTION

Typically, clapboard siding panels, such as fiber cement clapboard siding panels, are installed on a wall of a structure, generally on a sheathing product, in one of two ways—either in a so called "blind nail" method or a so called "face nail" method. In the blind nail method, illustrated by siding panel assembly 20 of FIG. 2, a first siding panel 16*a* is aligned on the face of a wall 12 and a series of horizontally spaced nails (not shown) is driven through the panel 16*a*, generally through an upper region of the exterior face of the panel 16*a*, into the wall 12. A second panel 16*b* is then secured to the wall 12 in the same manner using a series of nails 18. The second panel 16*b* overlaps a portion of the exterior face of the first panel 16*a* and covers the nails or fasteners driven through the first panel 16*a*. Another panel (not shown) is then installed overlapping panel 16*b* and covering nails 18. FIG. 3 is a side cross-sectional view of the panel assembly 20 of FIG. 2.

In the face nailing method shown by panel assembly 10 of FIG. 1, the first siding panel 14*a* is properly aligned on the wall 12. A second siding panel 14*b* is then aligned overlapping the first siding panel 14*a*, as described above, and nails 18*a* are driven through both siding panels 14*a*, 14*b*, exposing the head of the nail 18*a* at the exterior surface of the second siding panel 14*b*. This process is repeated with subsequent siding courses, such as panels 14*c* and 14*d* shown in FIG. 1, using nails 18*b* and 18*c*.

Installation of siding panels as described above often requires two workers—a first worker to steady a first end of the overlapping siding panel and a second worker to both steady and nail a second end of the siding panel to the wall. Providing a consistent lap along overlapping siding panels and between the various tiers of siding panels is also a concern. Still further, workers often perform certain ancillary tasks during installation of siding, such as taking of various measurements and cutting of siding panels, particularly to match the pitch of a gable in a roof.

In light of the above, there is a need for an inexpensive, multipurpose tool useful for installing siding panels, including for use in facilitating the installation of the siding panel, providing consistent lap results and serving as a measuring device.

SUMMARY OF THE INVENTION

A siding installation tool is provided comprising a main body portion including a spacing flange. The spacing flange includes a hook member disposed to hang the tool from a top edge of a first siding panel and a seat member disposed to receive the bottom edge of a second siding panel, wherein the flange portion is sized to provide a partial overlap of the first siding panel by the second siding panel when the tool is attached to the first siding panel by the hook member and the second siding panel is seated in the seat. The tool also includes measuring means located on the tool.

The multipurpose tool is lightweight and inexpensive to produce while at the same time providing a plethora of useful functions, a number of which are described herein. The tool can be produced in any size or three dimensional shape as may be required for particular applications. The tool includes a flange for assisting in the installation of partially overlapping siding products, allowing the installer to install long lengths of siding without the need for another worker but with consistent lapping. Leveling vials may be secured to the tool as needed, and the tool may be provided with any number of indicia useful for measuring lengths and angles, striking lines or stenciling patterns. Finally, the tool may be used as a cutting guide for ensuring straight cuts and providing mitered cuts.

In one embodiment, a siding installation tool includes a main body portion forming a right angle having a pair of base legs and a hypotenuse side connected therebetween. A first one of the base legs including distance measurement indicia thereon. The hypotenuse includes angle indicia thereon, and a second one of the base legs includes a flange portion coupled thereto. The flange portion includes a hook member disposed to hang the tool from a top edge of a first siding panel and a seat member disposed to receive the bottom edge of a second siding panel, wherein the flange portion is sized to provide a partial overlap of the first siding panel by the second siding panel when the tool is attached to the first siding panel by the hook member and the second siding panel is seated in the seat.

A method of installing siding panel is also provided. The siding installation tool is secured from the top edge of a first siding panel aligned along the surface of a wall. A bottom edge of a second siding panel is disposed in the seat of the flange to support the second siding panel. At least a first portion of the second siding panel is secured to the wall of the structure while the second siding panel is supported. The tool is detached from the first siding panel.

The above and other features of the present invention will be better understood from the following detailed description of the preferred embodiments of the invention that is provided in connection with the accompanying drawings.

BRIEF DESCRIPTION OF THE DRAWINGS

The accompanying drawings illustrate preferred embodiments of the invention, as well as other information pertinent to the disclosure, in which.

DETAILED DESCRIPTION

Figure 4:
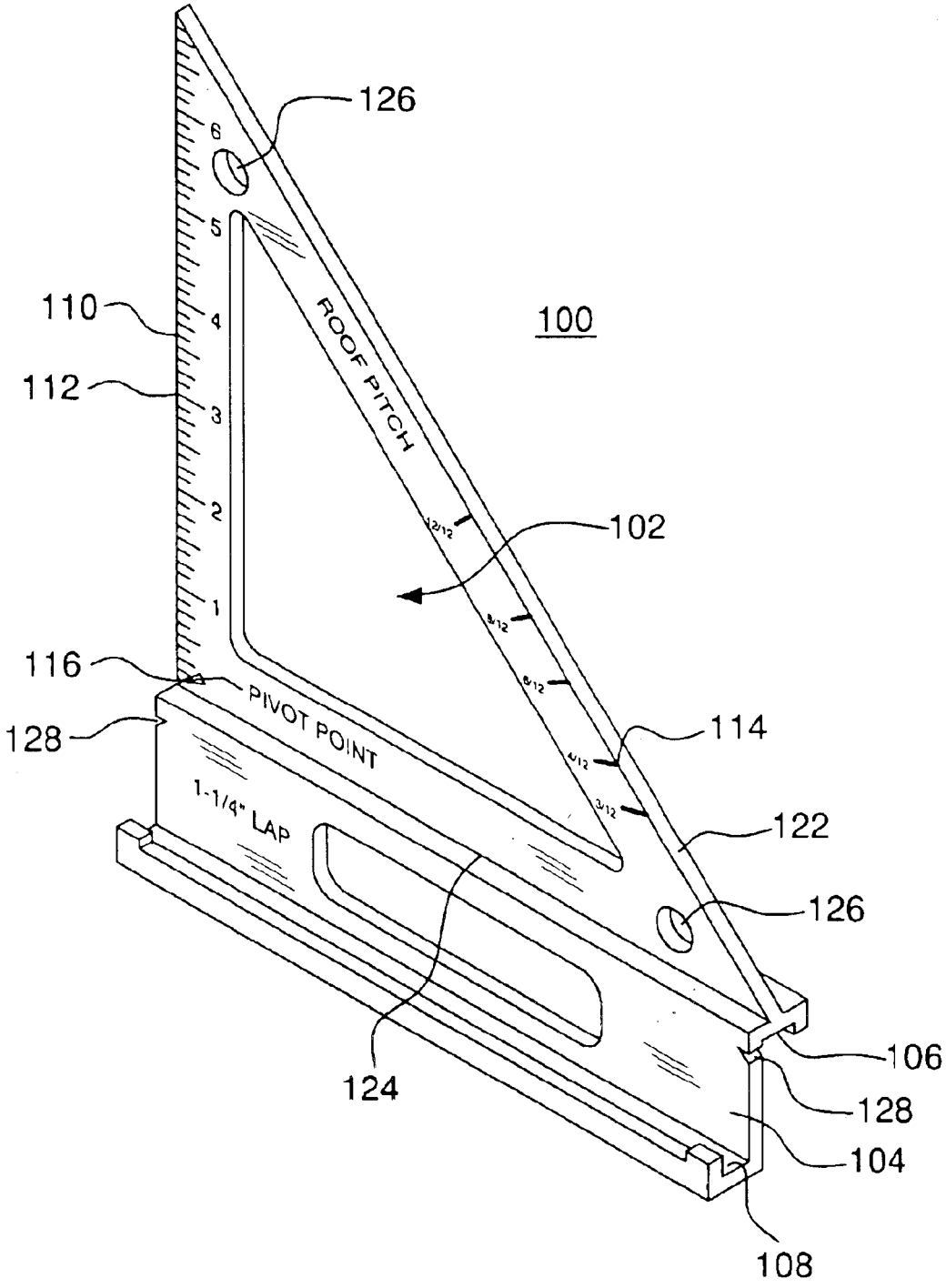
FIG. 4 is an isometric view of a tool in accordance with the invention.
Figure 6:
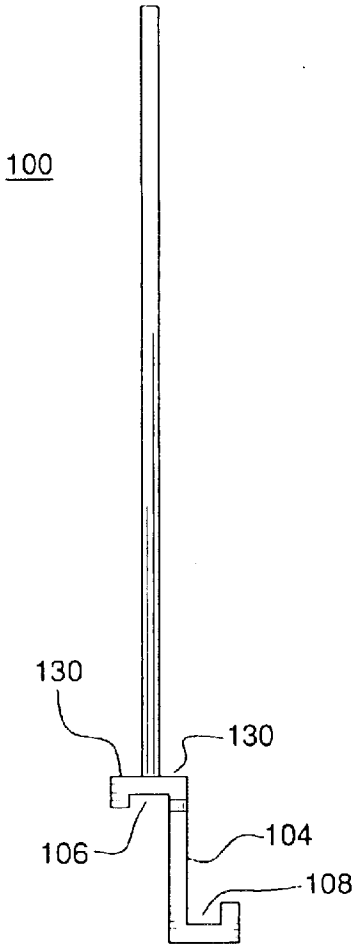
FIG. 6 is a side elevation view of the tool of FIG. 4.

The tool of the present invention is described in connection with FIGS. 4–6, which are not drawn to scale. Referring first to FIG. 4, a multipurpose tool 100 for use in installing siding panel is shown in perspective. Tool 100 has a main body portion 102. In one embodiment shown in FIG. 1, the tool is triangular shaped, preferably shaped like a right triangle, although the tool shape is not limited thereto, but may comprise any conceivable geometric configuration. The tool 100 includes a lap alignment flange 104 extending from the main body portion 102. The flange 104 includes a seat member 106 and a hook member 108, both of which are generally "u" shaped. FIG. 6 is a side elevational view illustrating a profile of the tool 100 and better illustrating the general "Z" of "S" shape of flange 104. Use of the flange 104 in installing a siding panel is described hereafter.

Figure 1:
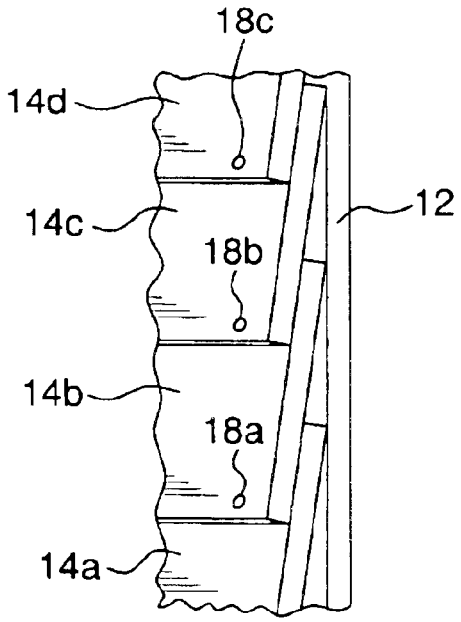
FIG. 1 (PRIOR ART)
FIG. 1 is a partial perspective view of a prior art face nail clapboard panel assembly.
Figure 2:
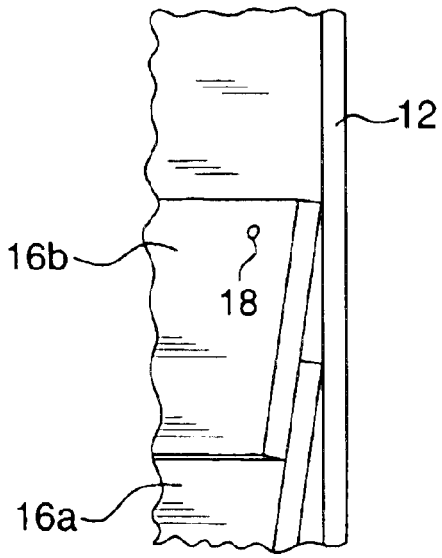
FIG. 2 (PRIOR ART)
FIG. 2 is a partial perspective view of a prior art blind nail clapboard panel assembly.
Figure 3:
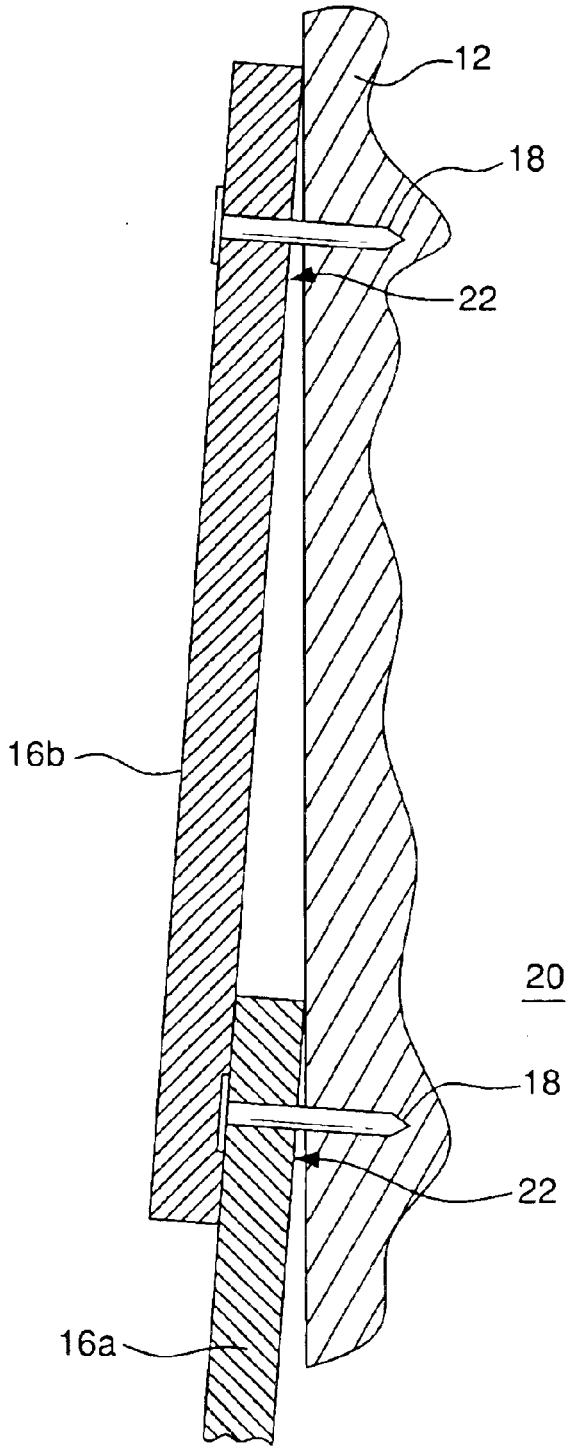
FIG. 3 (PRIOR ART)
FIG. 3 is a side cross-sectional view of the assembly of FIG. 2.

A first siding panel is properly aligned along a wall of a structure. As shown in FIGS. 1 and 2, siding panels are generally rectangular and are oriented in a longitudinal fashion along a wall. After the first siding panel is properly aligned, tool 100 is secured to a top edge of the first siding panel, preferably proximate to a first end thereof. With respect to FIG. 4, the orientation of tool 100 reversed, i.e., the tool is flipped, so that the tool 100 is hung from the top edge of the first siding panel by hook member 108. Hook member 108 is appropriately sized to fit over the top edge of a siding panel to firmly, but removably, secure the tool 100 thereto. In this manner, seat 106 is oriented to receive a bottom edge of a second siding panel aligned to overlap the first siding panel. The bottom edge of the second siding panel is disposed in the seat 106 of the suspended tool 100 to support the siding panel as the installer nails, screws or otherwise fastens at least a first portion of the second siding panel to a wall, as described above. The tool is then removed from the first siding panel, e.g., by sliding it off of the first siding panel, and a remaining portion of the second, overlapping siding panel is fastened to the wall. One or more tools 100 may be utilized in this process to support the second siding panel during installation.

It should be apparent that the tool 100, and more specifically the flange 104, provides support for the second siding panel during installation, thereby allowing a single installer to install long lengths of siding without the need for another worker. Further, the flange 104 is sized to provide a consistent, desired overlap (e.g., 1¼") between the first and second siding panels. Still further, reuse of the tool in completing a siding panel assembly, i.e., aligning and securing a third siding panel over the second siding panel, etc., ensures a consistent overlap between each pair of overlapping siding panels in the assembly. Other features of the tool 100 are described below.

A straight edge 110 of the tool body 102 is provided with indicia 112, along a length thereof such that the tool may be used to define distances, in a manner similar to a ruler. In the embodiment shown, the indicia 112 comprise a series of parallel spaced apart straight line markings each of which has a corresponding distance with reference to a point of origin 116, such as the point labeled "PIVOT POINT" on the face of tool 100. Indicia 112 may also include, but are not limited to, dots, protuberances, indentations, notches, holes, electronic sensors, and photonic sensors.

Figure 5:
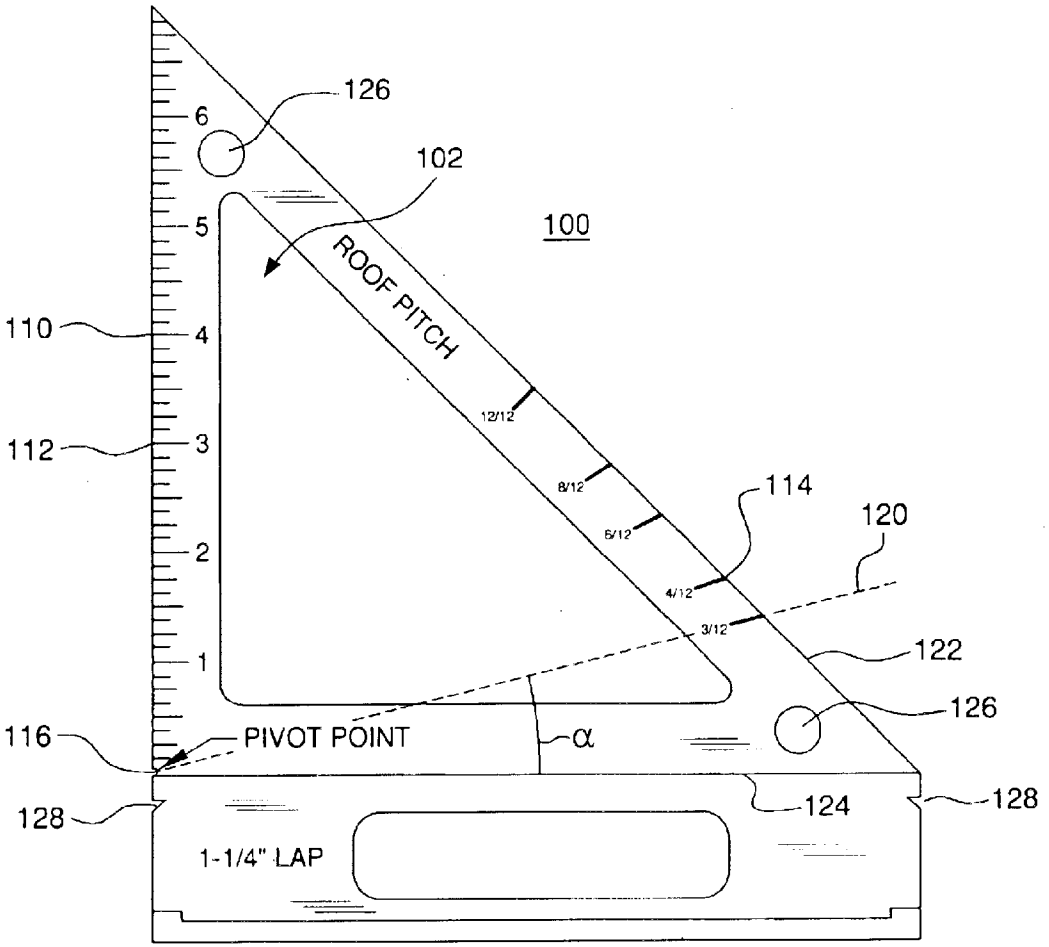
FIG. 5 is a top plan view of the tool of FIG. 4.

Tool 100 further includes means for defining angles, which includes indicia 114 provided on the hypotenuse of the tool body 102, each of which, in combination with point of origin 116, define a line 120, as shown for example in the top planar view of FIG. 5. In the embodiment shown, the indicia 114 consist of lines provided along the hypotenuse edge 122 that is opposite the right angle defined by the first and second edges 110, 124 of tool 100. The line 120 forms an angle (alpha) with reference to the straight edge 124 of the tool body 102. Indicia 114 may include, but are not limited to lines, dots, protuberances, indentations, notches, holes, electronic sensors and photonic sensors. Further, it will be understood that while it may be preferable to employ one or more edges of the tool body 102 to define angles, it is not necessary. Alternatively, angles may be defined by a pair of lines or by at least three spaced apart indicia that define lines that interest at corresponding angles. In one embodiment, the tool indicia 114 represent standard roof pitches and the tool 100 may be used to aid the installer in cutting siding to correspond to a specific roof pitch. This use of tool 100 is described below.

When siding reaches the eaves on the gable end of a house or other structure, the siding must be cut to match the roof pitch. As noted, in one embodiment, the indicia 114 represent common roof pitches (vertical/horizontal), e.g., 12/12, 8/12, 6/12, 4/12 and 3/12. Indicia 114 may be embodied as lines that are oriented with respect to point 116 to correspond to various pitches. The tool 100 may be used to assist the installer in the cutting process. Specifically, the tool is used in the marking of the piece of siding product that is cut to match a specific roof pitch. The installer usually measures and/or calculates the pitch of a roof before cutting the siding. The location 116 of the tool 100 (labeled "Pivot Point" on the tool 100) is positioned at the long point of the cut and rotated to match the pitch of the roof. The "long point" of the cut is where the cut meets the bottom of the siding panel. Conversely, the "short point" of the cut is where the cut meets the top of the siding panel. Specifically, with the tool 100 oriented as shown in FIG. 5, the pivot point is located at a point along bottom edge of the panel. The tool 100 is rotated counter-clockwise until the desired pitch indicia 114 aligns with the vertical end edge of the panel. For example, if the roof pitch is 12/12, the tool is rotated until the pitch indicia "12/12" line is aligned with the edge of the board—in essence a 45° counter-clockwise rotation from the orientation of FIG. 5. A line is drawn on the siding panel using a marking device (e.g., pencil) using the hypotenuse edge 122 as a guide. The siding panel is then cut along the line, thereby providing an edge that matches the selected pitch.

Alternatively, the tool 100 may be used to define angles by placing the tool 100 on the surface of an object (e.g., siding panel) such that that the edge 124 of the tool is aligned with a longitudinal line of the object. With the tool 100 held in position, a first mark or indicia is placed on the object at the point of origin 116 defined by the tool 100. A second mark is placed on the object at an indicia 114 corresponding with the desired angle. The tool 100 is then removed from the object to reveal the two marked indicia placed thereon. Next, a straight edge of the tool 100 may be used to strike a line through the two indicia, thereby denoting the position of the angle on the surface of the object. The object may then be cut along the struck line.

The tool may also be used as a guide for marking lines, such as cutting guides, parallel to edges of a siding board or other product. Installers often need to cut siding panels to narrower widths, such as when the siding panel is to be installed under and over windows and doors. In these installation, the siding panel is cut along a line parallel to the bottom and top edges. By way of example, assume 4" are to be removed relative to the bottom edge of the siding panel. Assuming a siding panel is oriented lengthwise on a flat surface, the tool 100 is rotated 180° (respective to FIG. 5) and placed on the siding panel with the "4" inch line indicia 112 positioned proximate to the bottom edge of the panel and edge 124 parallel to the top and bottom edges of the siding panel. The installer then generally secures the tool 100 relative to the bottom edge, such as with his or her index and thumb fingers, places the tip of a pencil or other marking instrument in a v-notch 128, and slides the tool 100 and pencil along the edge of the siding panel using his or her thumb and index as a guide along the bottom edge of the panel, thereby drawings a line approximately 4" from the bottom edge and parallel to the bottom edge. The distance from edge 124 to v-notches 128 generally accounts for the thickness of the cutting blade used to cut the siding panel along the drawn line.

Alternatively, indicia 112 could each have notches formed thereat for placement of a marking tool, and shelves 130 could be used as guides when rested along the edge of the siding panel. A lines is then drawn by simply sliding the tool 100 and pencil along the edge of the siding panel, using a shelve 130 as a guide.

Other useful applications of tool 100, not specifically discussed herein, will be readily apparent to those skilled in the art.

In one embodiment, the tool 100 may be a unitary construction formed from a light weight plastic, but other materials, such as metals and composites, are also contemplated. Preferably, the measurement indicia is disposed or located on both side of the tool 100 so that both sides are functional.

In one embodiment, tool 100 may also include holes 126, protrusions, hooks or other means for enabling an installer to secure the tool to a tool belt or nest the tool on a saw station.

The multipurpose tool is lightweight and inexpensive to produce while at the same time providing a plethora of useful functions, a number of which are described herein. The tool 100 can be produced in any size or there dimensional shape as may be required for particular applications. The tool includes a flange for assisting in the installation of partially overlapping siding products, allowing the installer to install long lengths of siding without the need of another worker but with consistent lapping. Leveling vials may be secured to the tool 100 as needed, and the tool may be provided with any number of indicia useful for measuring lengths and angles, striking lines or stenciling patterns. Finally, the tool 100 may be used as a cutting guide for ensuring straight cuts and providing mitered cuts.

Although the invention has been described in terms of exemplary embodiments, it is not limited thereto. Rather, the appended claims should be construed broadly to include other variants and embodiments of the invention that may be made by those skilled in the art without departing from the scope and range of equivalents of the invention.

What is claimed is:

1. A siding installation tool, comprising:

a main body portion having a first edge and a second edge forming a right angle thereto and a third edge between said first and second edges, a first one of said first and second edges having a spacing flange coupled thereto, said spacing flange including:

a hook member disposed to hang said tool from a top edge of a first siding panel; and a seat member disposed to receive the bottom edge of a second siding panel, wherein said flange portion is sized to provide a partial overlap of said first siding panel by said second siding panel when said tool is attached to said first siding panel by said hook member and said second siding panel is seated in said seat; and measuring means located on said tool.

2. The tool of claim 1, wherein said hook member is generally "u" shaped.

3. The tool of claim 1, wherein said seat member is generally "u" shaped.

4. The tool of claim 1, wherein the main body of the tool forms a right triangle, said third edge corresponding to the hypotenuse of said right triangle.

5. The tool of claim 1, wherein said measuring means comprises means for defining an angle.

6. The tool of claim 5, wherein the means for defining an angle includes two straight edges defining an angle of 90 degrees.

7. The tool of claim 5, wherein the means for defining an angle comprise two indicia defined on the tool, which are spaced apart from a point of origin defined on said tool, which together with the point of origin define an acute angle.

8. The tool of claim 7, wherein one of the indicia is provided on the third edge and the other indicia is provided on at least one of the first and second edges.

9. The tool of claim 7, wherein the indicia comprise at least one of a line, a dot, a protuberance, an indentation, a hole, electronic sensors and photonic sensors.

10. The tool of claim 1, wherein the measuring means includes means for defining a distance.

11. The tool of claim 10, wherein the measuring means for defining a distance includes a straight line with indicia thereon, said means for defining a distance being disposed at at least one of said first and second edges.

12. The tool of claim 1, wherein said measuring means includes means for defining a plurality of angles, said angles corresponding to a plurality of different roof pitch angles.

13. A siding installation tool, comprising:

a main body portion forming a right angle having a pair of base legs and a hypotenuse side connected therebetween, a fist one of said base legs including distance measurement indicia thereon, said hypotenuse side including angle indicia thereon and a second one of said base legs including a flange portion coupled thereto, said flange portion including:

a hook member disposed to hang said tool from a top edge of a first siding panel; and a seat member disposed to receive the bottom edge of a second siding panel, wherein said flange portion is sized to provide a partial overlap of said first siding panel by said second siding panel when said tool is attached to said first siding panel by said hook member and said second siding panel is seated in said seat.

14. The tool of claim 13, wherein said angle indicia correspond to a plurality of roof pitches.

15. A method of installing siding panel, comprising the steps of:

(a) securing a siding installation tool from a top edge of a first siding panel aligned along the surface of a wall, said installation tool comprising:

a main body portion having a first edge and a second edge forming a right angle thereto and a third edge between said first and second edges, a first one of said first and second edges having a spacing flange coupled thereto, said spacing flange including:

a hook member disposed to hang said tool from a top edge of said first siding panel; and a seat member disposed to receive the bottom edge of a second siding panel, wherein said flange portion is sized to provide a partial overlap of said first siding panel by said second siding panel when said tool is attached to said first siding panel by said hook member and said second siding panel is seated in said seat; and measuring means located on said tool;

(b) disposing a bottom edge of said second siding panel in said seat of said flange to support said second siding panel;

(c) securing at least a first portion of said second siding panel to the wall of said structure while said second siding panel is supported; and (d) detaching said tool from said first siding panel.

16. The method of claim 15, wherein said securing step includes the step of disposing fasteners through said second siding panel and into said wall.

17. The method of claim 16 wherein said fasteners include nails or screws or a combination thereof.

18. The method of claim 15 wherein said siding panels are clapboard siding panels.

19. The method of claim 15 wherein said siding panels are fiber cement clapboard siding panels.

20. The method of claim 15, wherein step (c) includes the step of aligning said second siding panel along said wall while said second siding panel is supported by said installation tool, said method further comprising the step of:

after step (d), maintaining an alignment of said second siding panel along said wall and securing a second portion of said siding panel to said wall of said structure.

* * * * *